US011815085B1

(12) United States Patent
Brunet

(10) Patent No.: US 11,815,085 B1
(45) Date of Patent: Nov. 14, 2023

(54) PUMP WITH FLUID END WITH EASY MAINTENANCE REPLACEABLE PACKING SLEEVE

(71) Applicant: Halliburton Energy Services, Inc., Houston, TX (US)

(72) Inventor: John Dexter Brunet, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/951,732

(22) Filed: Sep. 23, 2022

(51) Int. Cl.

| | |
|---|---|
| ***F04B 53/02*** | (2006.01) |
| ***F04B 53/22*** | (2006.01) |
| ***F04B 53/18*** | (2006.01) |
| ***E21B 43/26*** | (2006.01) |
| ***F04B 53/16*** | (2006.01) |

(52) U.S. Cl.
CPC ..... *F04B 53/02* (2013.01); *E21B 43/26* (2013.01); *F04B 53/16* (2013.01); *F04B 53/18* (2013.01); *F04B 53/22* (2013.01)

(58) Field of Classification Search
CPC ..... F04B 53/02; F04B 53/16; F04B 53/164; F04B 53/18; F04B 53/22
See application file for complete search history.

(56) References Cited

U.S. PATENT DOCUMENTS

| | | | | |
|---|---|---|---|---|
| 6,544,012 | B1 * | 4/2003 | Blume | F04B 53/1032 417/454 |
| 6,623,259 | B1 * | 9/2003 | Blume | F04B 53/164 417/454 |
| 9,827,967 | B2 * | 11/2017 | Schuller | B60T 8/4031 |
| 10,935,023 | B2 * | 3/2021 | Plantard | F16K 31/1225 |
| 11,421,679 | B1 * | 8/2022 | Mullins | F04B 53/164 |
| 11,441,687 | B2 * | 9/2022 | Hurst | F04B 15/02 |
| 2017/0260825 | A1 | 9/2017 | Schmidt et al. | |
| 2019/0247957 | A1 | 8/2019 | Stribling et al. | |
| 2020/0232456 | A1 * | 7/2020 | Plantard | B05B 9/0413 |
| 2020/0362971 | A1 * | 11/2020 | Hurst | F04B 53/02 |
| 2020/0386214 | A1 | 12/2020 | Hurst et al. | |
| 2021/0270087 | A1 * | 9/2021 | Brunet | F16C 35/02 |

FOREIGN PATENT DOCUMENTS

| | | | | |
|---|---|---|---|---|
| WO | WO-2021195572 | A1 * | 9/2021 | F04B 53/164 |
| WO | WO-2022011712 | A1 * | 1/2022 | |

* cited by examiner

*Primary Examiner* — Thomas E Lazo
(74) *Attorney, Agent, or Firm* — John Wustenberg; Parker Justiss, P.C.

(57) ABSTRACT

A pump for use in a hydraulic fracturing system, the pump including a conical packing sleeve including a tapered segment adjacent a pump insertion side a pilot and sealing segment adjacent and contiguous with the tapered segment and an attachment segment adjacent and contiguous with the pilot and sealing segment and adjacent a pump removal side. Methods of installing, removing and replacing the sleeve are also disclosed.

20 Claims, 8 Drawing Sheets

PUMP WITH FLUID END WITH EASY MAINTENANCE REPLACEABLE PACKING SLEEVE

BACKGROUND

Replaceable packing sleeves help extend the life of a fluid end of a hydraulic fracturing pump (frac pump) by making it possible to replace a worn-out packing bore surface. The packing bore surface wears out due to the reciprocating motion of the plunger in the fluid end acting on the packing, which in turn, acts on the packing bore. When the packing bore surface is worn-out, the pump loses it's fluid seal and the fluid end must be replaced, or a replaceable packing sleeve must be utilized. When the packing sleeve is worn out, it can be replaced at lower expense than replacing the much more expensive fluid end. This is in addition to having to replace other parts in the fluid end, including replacing the packing stack. Some replaceable packing sleeves are press-fit into the bore of the fluid end. Press-fitting, however, is complicated, and often requires multiple personnel to operate a system that can include, e.g., a heavy hydraulic jack with a hydraulic power unit to push or pull the sleeve, attached high pressure hoses and jaw fittings on the hydraulic jack to install and remove the packing sleeve. The use of high pressures (e.g., up to 10,000 psi) to operate the system entails the use of safety precautions to mitigate danger to the personnel related to the use of high pressures. As such, replaceable packing sleeve installation and removal are costly and time consuming to implement.

Accordingly, there is a continuing need to develop simpler replaceable packing sleeve configurations with easier installation and replacement procedures.

BRIEF DESCRIPTION

Figure 1:
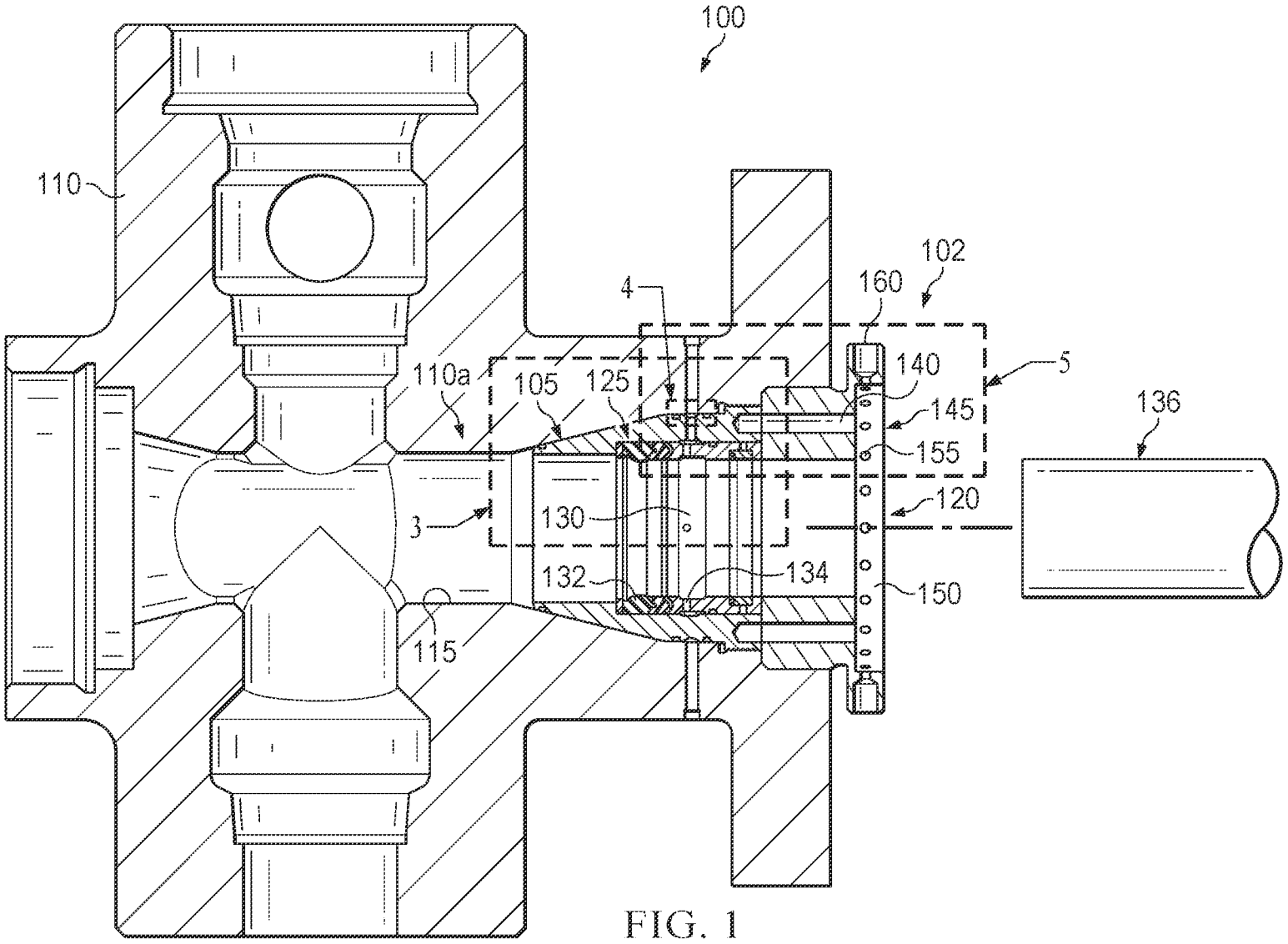
Figure 2A:
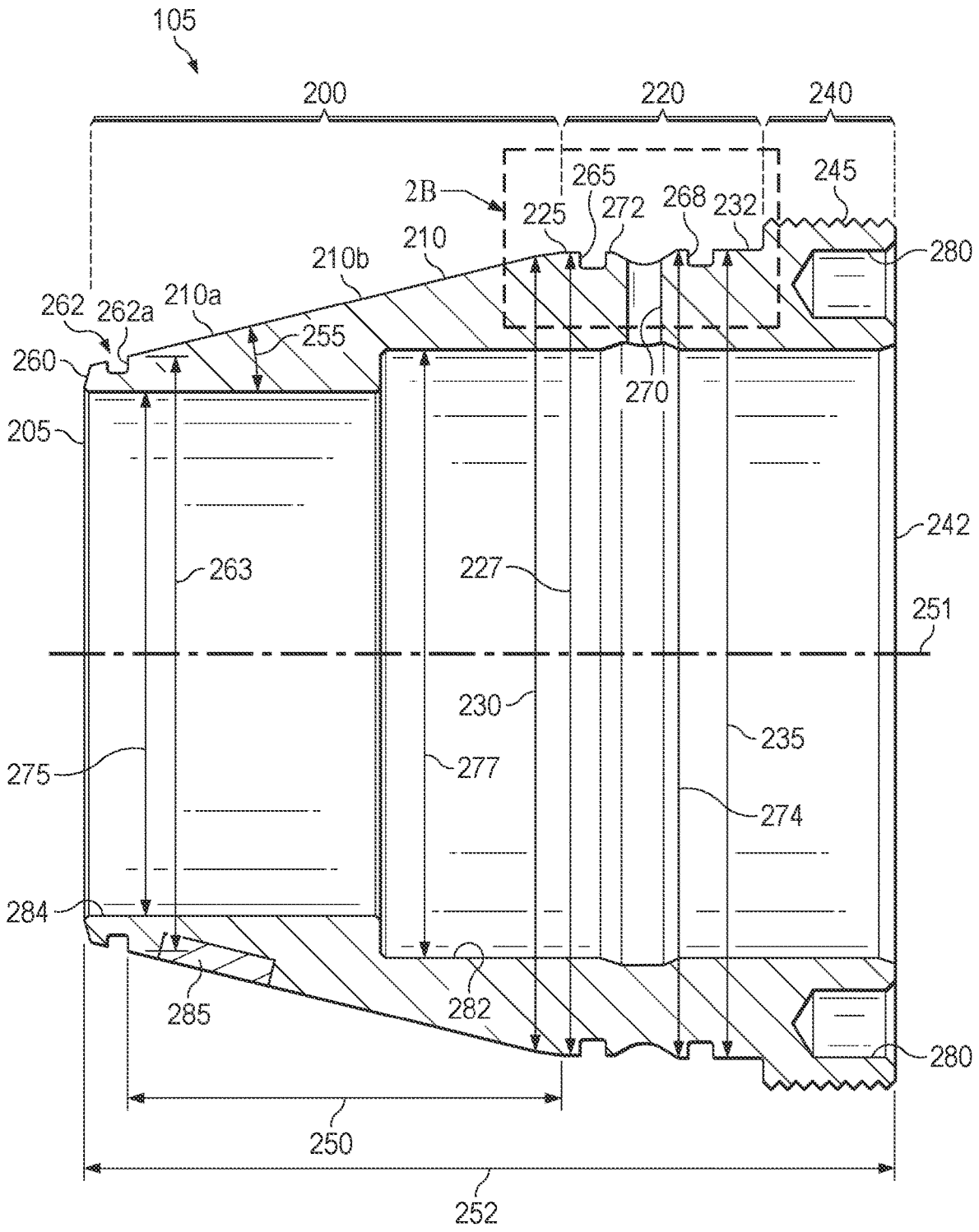
Figure 2B:
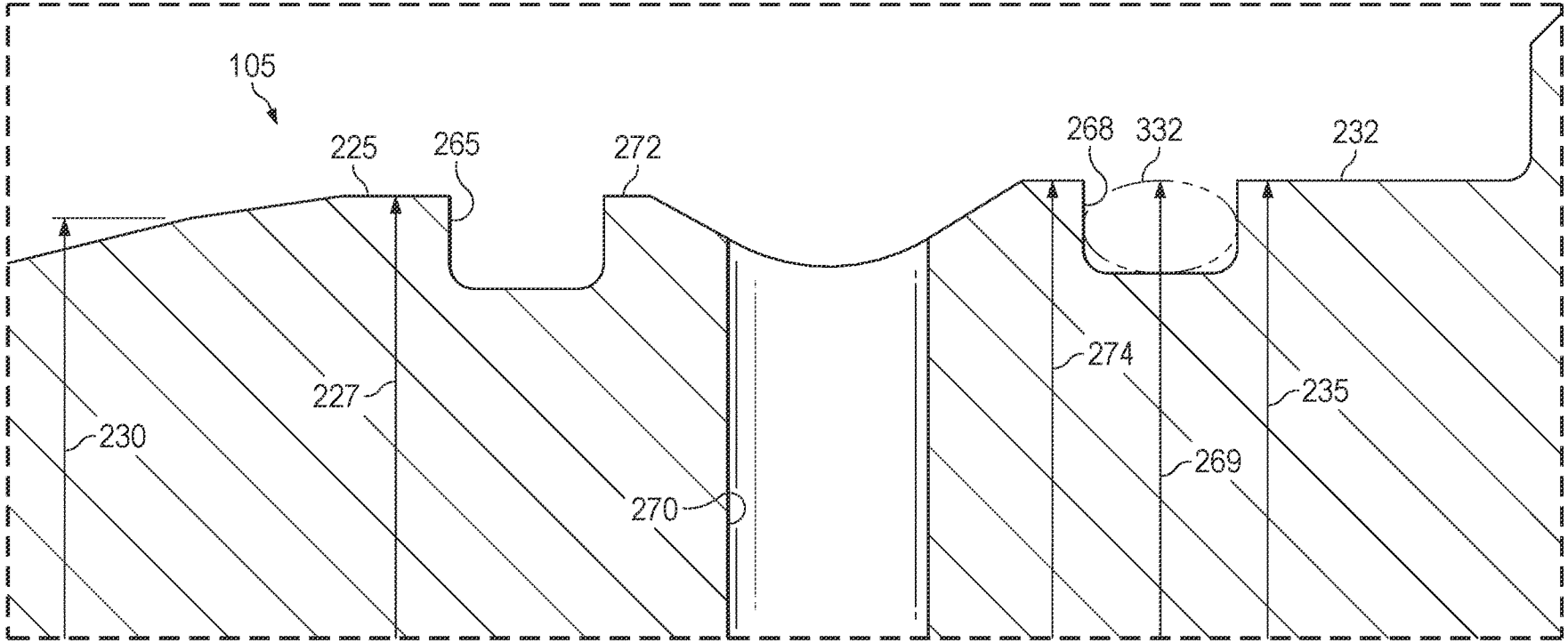
Figure 3:
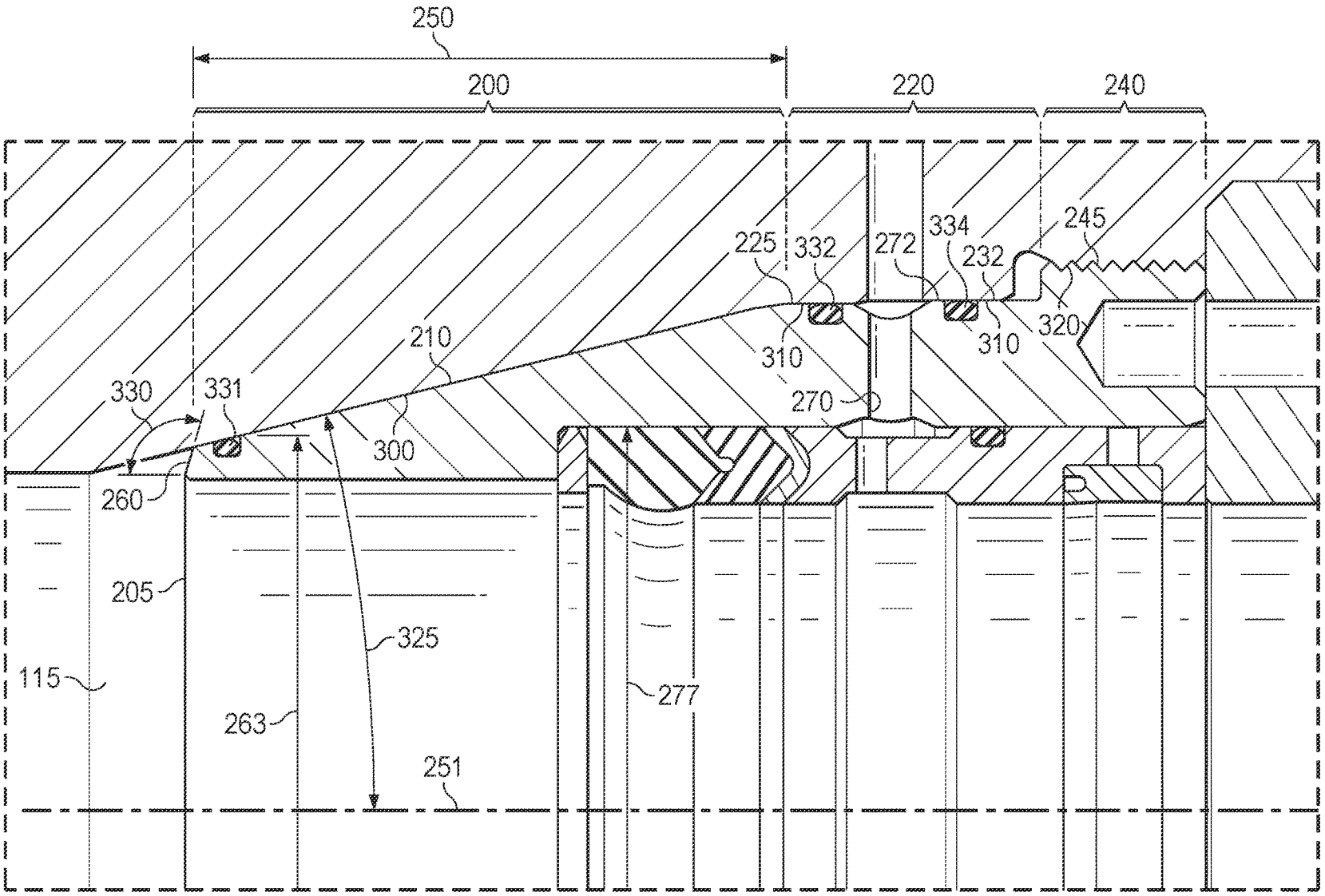
Figure 4:
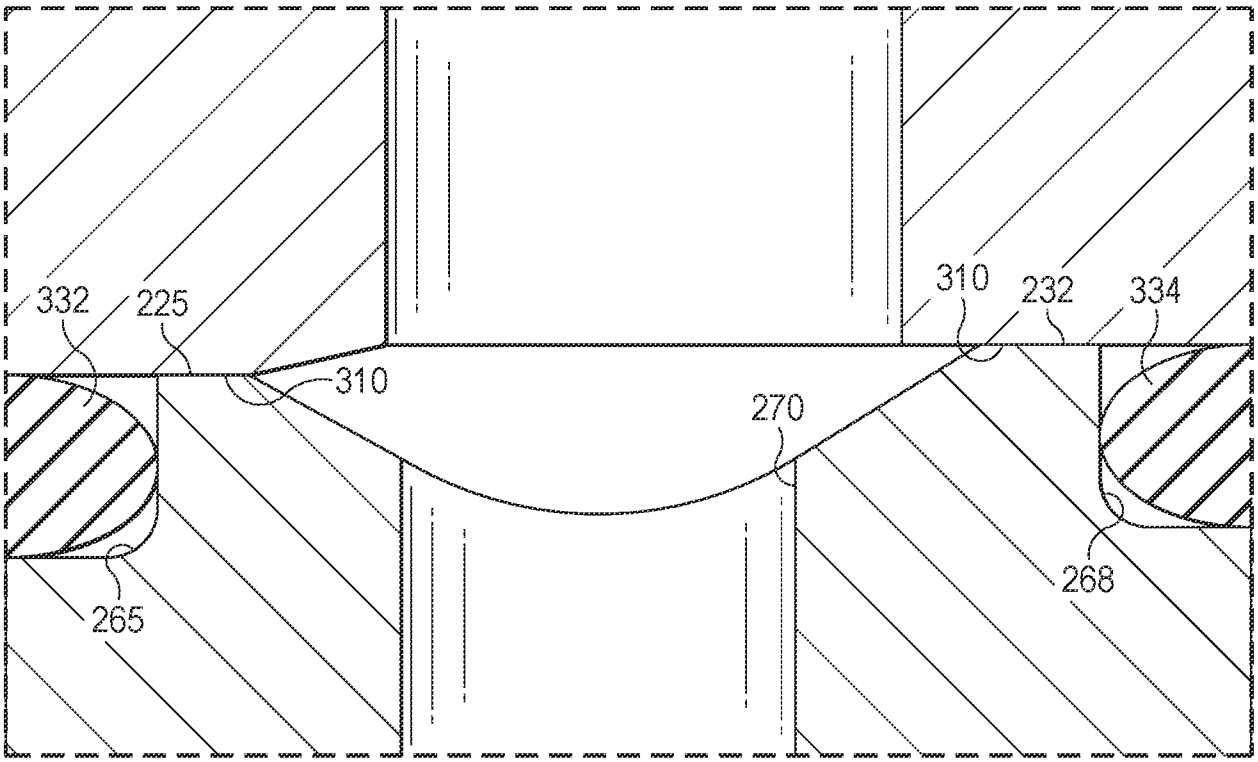
Figure 5:
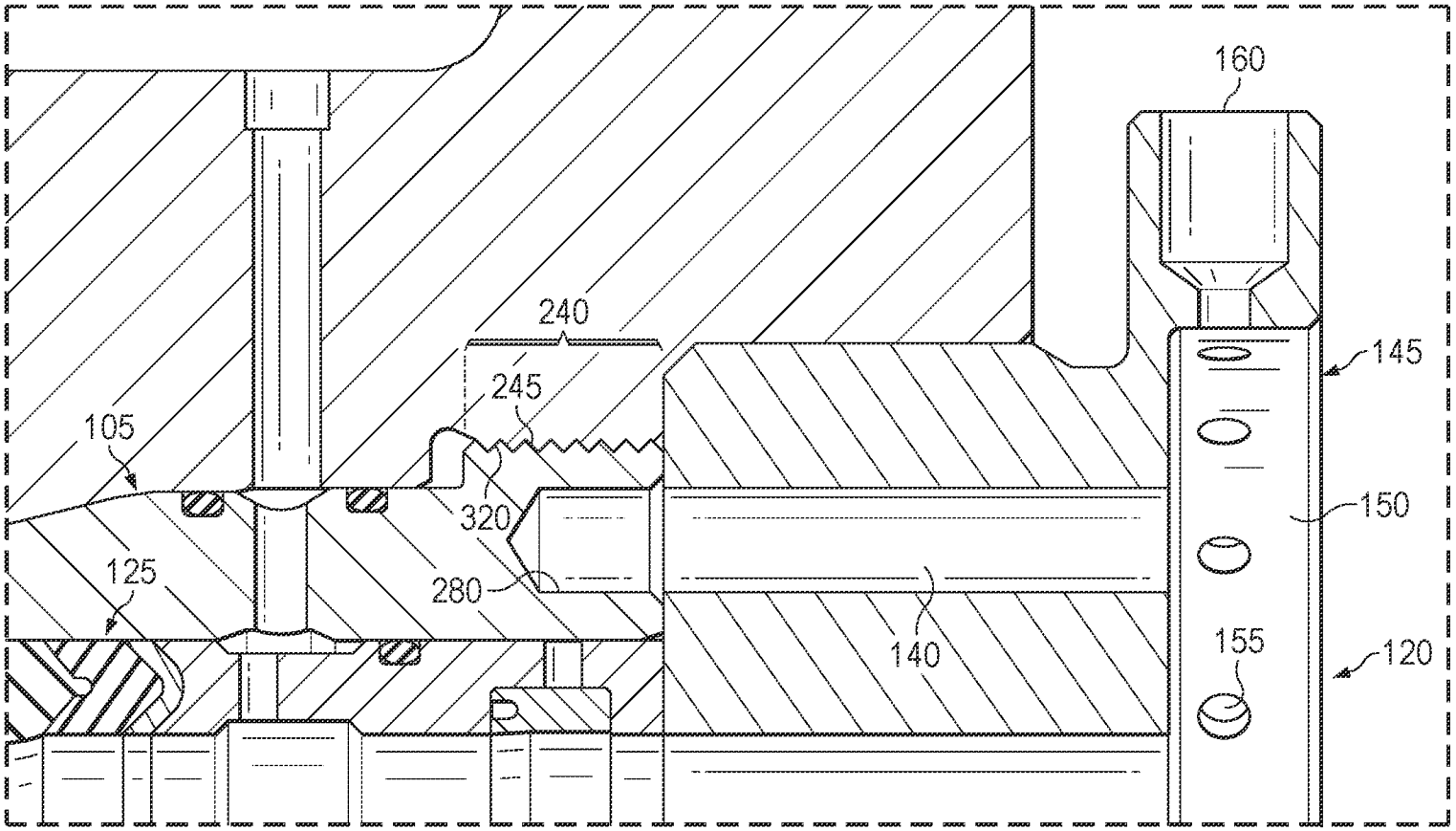
Figure 6A:
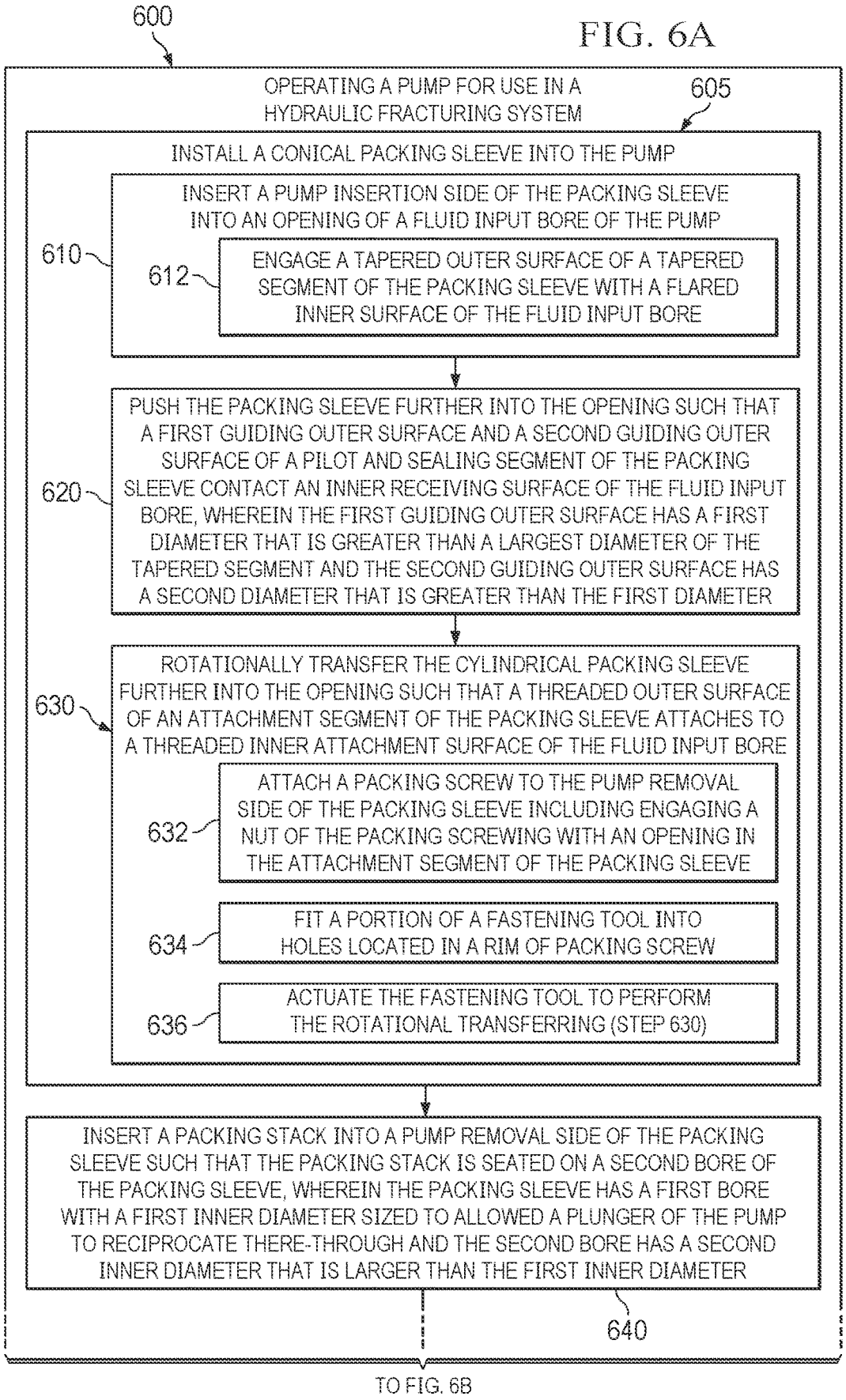
Figure 6B:
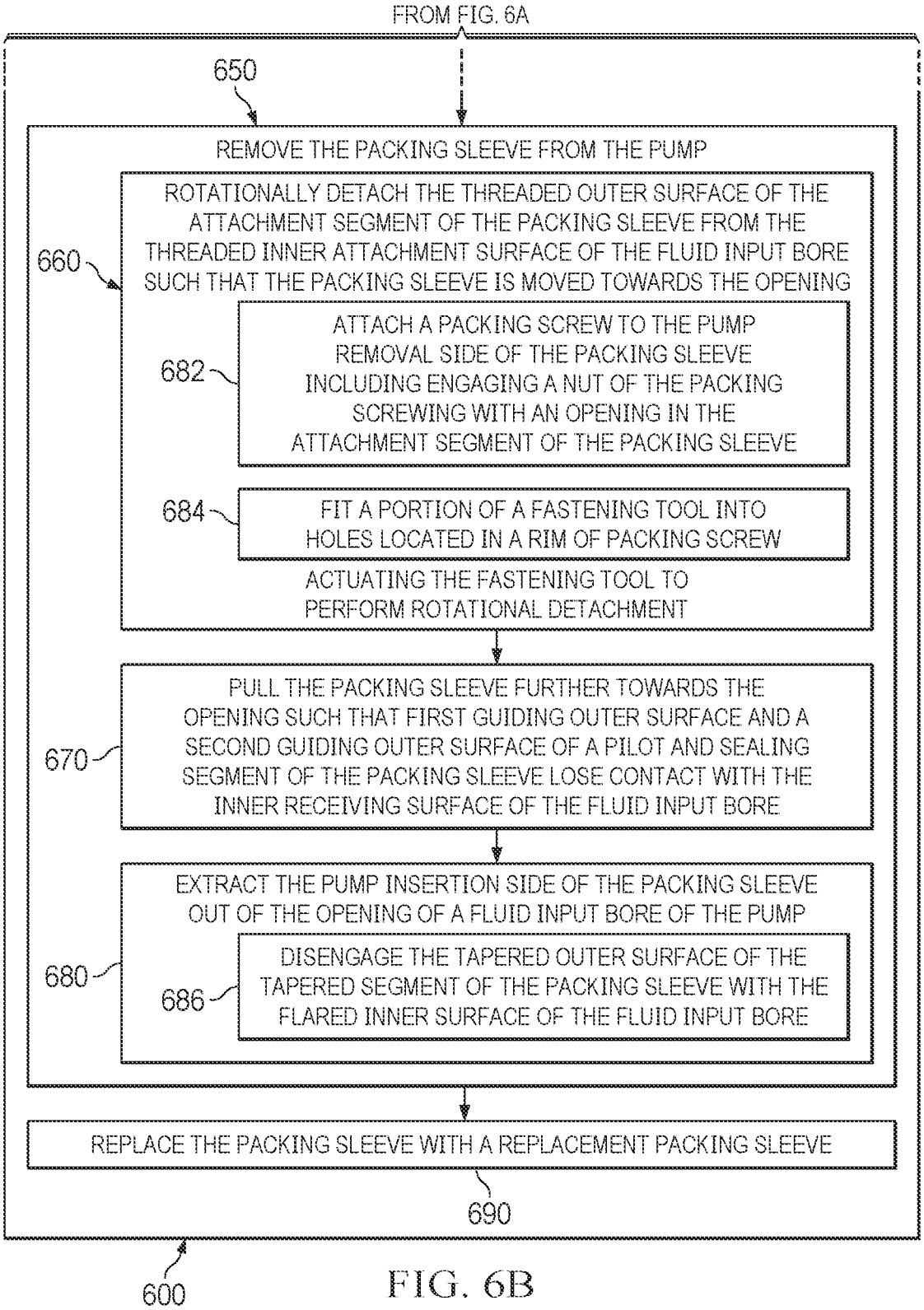

Reference is now made to the following descriptions taken in conjunction with the accompanying drawings, in which:

FIG. 1 illustrates a general view of an example pump for a hydraulic fracturing system for a wellbore in which any embodiments of the replaceable packing sleeve of the disclosure can be used;

FIG. 2A presents a cross-sectional view of an example replaceable conical packing sleeve of the disclosure such as the packing sleeve depicted in FIG. 1;

FIG. 2B presents a detailed cross-sectional view of portions of the tapered segment and pilot and sealing segment as presented in FIG. 2B;

FIG. 3 presents a detailed cross-sectional view of portions of the tapered segment, pilot and sealing segment, and, attachment segment of the example packing sleeve, and, portions of the pump body defining the liquid input bore as presented in FIG. 1;

FIG. 4 presents a detailed cross-sectional view of a portion of an example pilot and sealing segment of the example packing sleeve and portions of the pump body defining the liquid input bore as presented in FIG. 1;

FIG. 5 presents a detailed cross-sectional view of a portion of an example attachment segment portion of the example packing sleeve and portions of the pump body defining the liquid input bore as presented in FIG. 1; and FIGS. 6A and 6B present a flow diagram of a method of operating a pump for use in a hydraulic fracturing system including installing and replacing any embodiments of the packing sleeve as disclosed herein

DETAILED DESCRIPTION

Disclosed herein is novel replaceable packing sleeve structure and associated method of installation and replacement. The replaceable packing sleeve reduces the burden of packing sleeve maintenance by eliminating the need for heavy and costly tools (e.g., the hydraulic jack and associated equipment), simplifies the process of packing sleeve installation and replacement and dispenses with the need to use high pressure for press-fitting, which mitigates inherent safety issues related to installation or replacement, as further disclosed herein.

In the drawings and descriptions that follow, like parts are typically marked throughout the specification and drawings with the same reference numerals, respectively. The drawn figures are not necessarily to scale. Certain features of this disclosure may be shown exaggerated in scale or in somewhat schematic form and some details of conventional elements may not be shown in the interest of clarity and conciseness. Some specific embodiments are described in detail and are shown in the drawings, with the understanding that they serve as examples and that they do not limit the disclosure to only the illustrated embodiments. Moreover, it is fully recognized that the different teachings of the embodiments discussed, infra, may be employed separately or in any suitable combination to produce desired results.

Unless otherwise specified, any use of any form of the terms such as "press," "connect," "engage," "attach," or any other term describing an interaction between elements is not meant to limit the interaction to direct interaction between the elements but include indirect interaction between the elements described, as well. In the following discussion and in the claims, the terms "including" and "comprising" are used in an open-ended fashion, and thus should be interpreted to mean "including, but not limited to." Further, any references to "first," "second," etc. do not specify a preferred order of method or importance, unless otherwise specifically stated but are intended to designate separate elements. The various characteristics mentioned above, as well as other features and characteristics described in more detail below, will be readily apparent to those skilled in the art with the aid of this disclosure upon reading the following detailed description of the embodiments, and by referring to the accompanying drawings.

FIG. 1 illustrates a general view of an example pump 100 (e.g., a fluid end 102 of a frac pump) for a hydraulic fracturing system associated with a wellbore in which any embodiments of the replaceable packing sleeve 105 of the disclosure can be deployed.

As familiar to one skilled in the pertinent art, the pump 100 can include a pump body 110, a portion 110*a* of which defines a liquid input bore 115 and opening 120 into which the packing sleeve 105 and a packing stack 125 (the stack including, e.g., a header ring 130, sealing element 132, and lubrication conduits 134). One skilled in the art would understand how a reciprocating plunger 136 would be placed into the fluid bore opening 120 and moved back and forth through the fluid input bore 115, the packing stack 125 and the surrounding packing sleeve 105, by a motorized device (e.g., a motorized crankshaft, not shown) to pump fluids into and out of a wellbore.

One embodiment of the disclosure is a replaceable packing sleeve for use in a hydraulic fracturing pump as part of a hydraulic fracturing system.

FIG. 2A presents a cross-sectional view of an example replaceable conical packing sleeve 105 ("sleeve") of the disclosure such as the sleeve depicted in FIG. 1 and FIG. 2B presents a detailed cross-sectional view of portions of the tapered segment and pilot and sealing segment as presented in FIG. 2B. FIG. 3 presents a detailed cross-sectional view of portions of the tapered segment, pilot and sealing segment, and, attachment segment of the sleeve, and, portions of the pump body defining the liquid input bore as presented in FIG. 1. FIG. 4 presents a detailed cross-sectional view of a portion of an example pilot and sealing segment of the sleeve and portions of the pump body defining the liquid input bore as presented in FIG. 1. FIG. 5 presents a detailed cross-sectional view of a portion of an example attachment segment of the sleeve and portions of the pump body defining the liquid input bore as presented in FIG. 1.

With continuing reference to FIGS. 1-5 throughout, embodiments of the packing sleeve 105 include a tapered segment 200, a pilot and sealing segment 220, and, an attachment segment 240. The tapered segment 200 is adjacent a pump insertion side 205 of the packing sleeve, (e.g., within 5 cm in some embodiments) the tapered segment including a tapered outer surface 210 that is engageable with a flared inner surface 300 (FIG. 3) in an opening 120 of a fluid input bore 115 of the pump 100. The pilot and sealing segment 220 is adjacent and contiguous with the tapered segment 200, the pilot and sealing segment including a first guiding outer surface 225 defined by a first diameter 227 that is greater than a largest diameter (e.g., diameter 230) of the tapered segment 200, and a second guiding outer surface 232 defined by a second diameter 235 that is greater than the first diameter 227, the first and second guiding outer surfaces contactable with an inner receiving surface 310 of the fluid input bore. The attachment segment 240 is adjacent and contiguous with the pilot and sealing segment 220 and adjacent a pump removal side 242 of the packing sleeve, the attachment segment having a threaded outer surface 245 that is attachable to a threaded inner attachment surface 320 of the fluid input bore 115. The threaded out surface helps reduce the amount of human force needed for installation, retention, and removal of the sleeve.

The term 'contiguous with' as used herein refers to the tapered segment 200, pilot and sealing segment 220, and, attachment segment 240 all being a single solid monolithic metal piece that has been molded, machined, welded or otherwise shaped to form the complete packing sleeve 105.

The terms, 'engageable', 'contactable' or 'attachable' as used herein means that, when the packing sleeve is positioned in, or removed from, the fluid input bore, all or nearly all (e.g., at least 90%, 95% or 99% in various embodiments) of the surface area of tapered outer surface 210 can touch the flared inner surface 300. For instance, all or nearly all of the first and second guide outer surfaces 225, 232 can touch, the inner receiving surface 310 of the fluid input bore 115, and all or nearly all of the threaded outer surface 245 can touch, the threaded inner attachment surface 320 of the fluid input bore. In some embodiments, once the packing sleeve is positioned in the fluid input bore, there can be a small clearance between the surfaces 210, 300 that is maintained by sealing O-rings, as further disclosed herein, such that the surfaces 210, 310 do not touch each other.

The term tapered outer surface 210 as used herein means that, for any two locations along the surface (e.g., location 210*a*, 210*b*) the diameter 230 at the location farther away (e.g., 210*b*) from the insertion end 205 is larger than the diameter 230 at the location nearer (e.g., 210*a*) the insertion end 205.

In some embodiments, it is desirable for the sleeve be structured to decrease a frictional force holding the replaceable packing sleeve 105 in the fluid input bore 115 so that the sleeve can be easily installed or removed from the fluid end 102 with little force (e.g., by a single human operator), and, to reduce stress in the sleeve. To facilitate such adjustment, a length 250 of the tapered outer surface, in a direction parallel to a long axis 251 of the packing sleeve 105, extends from a first external o-ring groove 265, located between the pump insertion side 205 and the tapered segment 200 to the pilot and sealing segment 220, can be a value in a range from at 50 to 95 percent (e.g., 50 to 60, 60 to 70, 70 to 80, 80 to 90 percent and any combinations thereof in various embodiments) of a total length 252 of the conical packing sleeve 105 along the long axis 251. For example, in an embodiment where the total length 252 of the sleeve in a direction parallel to the long axis 251 equals 0.2 m then the length 250 of the tapered outer surface 210 can be a value from ranging from 0.1 to 0.19 m.

In some embodiments, it is desirable for a frictional force holding the replaceable packing sleeve 105 in the fluid input bore 115 to be such that the sleeve can be easily removed from the bore 115 with little force. For some such embodiments, an outer angle 255 of the tapered outer surface 210 and an inner angle 325 of the flared inner surface 300, relative to a long axis 251 of the packing sleeve, can be substantially equal to each other, e.g., a same angle value within ±1 degree and for both the outer angle 255 and the inner angle 325 to be greater than, up to 1 degree greater than, and in some embodiments, from greater than 1 degree to 5 degrees greater than, a friction angle between the tapered the outer surface and the flared inner surface whereby the tapered outer surface 210 and the flared inner surface 300 are not locked together. That is, the tapered outer surface 210 and the flared inner surface 300 are angled such that a locking taper angle is not present.

In other embodiments, a frictional force holding the packing sleeve 105 in the fluid input bore 115, the outer angle 255 of the tapered outer surface 210 can be such that the sleeve is locked in the fluid input bore 115. For some such embodiment, the outer angle 255 of the tapered outer surface 210 and the inner angle 325 of the flared inner surface 300, relative to a long axis 251 of the packing sleeve, can be substantially equal to each other and both the outer angle 255 and the inner angle 325 are less than, e.g., up to 5 degree less than, a friction angle between the tapered outer surface and the flared inner surface to thereby lock the tapered outer surface 210 and the flared inner surface 300 together by the frictional force between these surfaces 210, 300

The term friction angle (Θ or angle of friction) as used herein refers to the theoretical angle, the arctan mathematical function, when it is applied to the coefficient of friction between the tapered outer surface 210 of sleeve and the inner surface 300 fluid input bore 115. The result of evaluating the arctan(coefficient of friction) is the friction angle Θ. When the angle 255 between the tapered outer surface 210 and the outer angle 255 of the tapered outer surface 210 relative to the central axis 251 are greater than the friction angle Θ, then there will be insufficient friction force to hold the two surfaces 210, 300 together and the surfaces slide with respect to each other.

One skilled in the pertinent art would understand that when the angle 255 is less than the friction angle (Θ) that this is sometimes referred to a locking taper angle. For instance, as noted above, when the outer angle 255 of the tapered outer surface 210 and the inner angle 325 of the flared inner surface 300 are substantially equal to each other and are both less than the friction angle then when these two surfaces 210, 300 are engaged with each other, then they will be held together by the force of friction between these two surfaces, e.g., sometimes referred to as a locking taper angle.

Consider, for example, embodiments where the coefficient of friction between the two surfaces 210, 300 is such that the friction angle (Θ) equals about 2 degrees, 5 degrees, 7 degrees, 10 or 15 degrees. In some such embodiments, the outer angle 255 of the tapered outer surface 210 and the inner angle 325 of the flared inner surface 300 can be substantially equal to each other (e.g., within ±1 degree) and equal to or less than a value of 2, 5, 7, 10 or 15 degrees, respectively, to thereby provide a locking taper angle. In some such embodiments, the outer angle 255 of the tapered outer surface 210 and the inner angle 325 can be less than and within about 10% (±1%) of the friction angle (Θ) (e.g., angles 255, 325 both equal to 1.8, 4.5, 6.3, 9, 13.5 degrees, respectively) to provide a locking taper angle that can advantageously still be unlocked by a small but manageable force (e.g., a single human operator).

One skilled in the pertinent art would understand that when the outer angle 255 of the tapered outer surface 210 and the inner angle 325 of the flared inner surface 300 are greater than the friction angle Θ, then there will be insufficient friction force to hold the two surfaces 210, 300 together and the surfaces will slide with respect to each other because there is insufficient friction to provide a locking taper angle. As noted above, some such embodiments of the sleeve 105 can have a tapered outer surface 210 and outer angle 255 that do not provide a locking taper. In some such embodiments, components of a packing stack that is seated in a second inner diameter 277 of the sleeve and the outer surface 245 of the threaded attachment segment 240 of the sleeve 105 can help retain the sleeve 105 in the fluid input bore 115, as familiar to those skilled in the pertinent art.

Consider, for example, the same above example where the coefficient of friction between the two surfaces 210, 300 is such that the friction angle (Θ) equals about 2 degrees, 5 degrees, 7 degrees, 10 or 15 degrees. In some such embodiments, the outer angle 255 of the tapered outer surface 210 and the inner angle 325 of the flared inner surface 300 can be greater than a value of 2, 5, 7, 10 or 15 degrees, respectively, e.g. to facilitate easy removal and replacement of the sleeve 105 from the fluid input bore 115. In some such embodiments the outer angle 255 of the tapered outer surface 210 and the inner angle 325 can be less than and within about 10% (±1%) of the friction angle (Θ) (e.g., angles 255, 325 both equal to 2.2, 5.5, 7.7. 11, 16.5 degrees, respectively), to provide some frictional support between the surfaces 210, 300, to facilitate easier sleeve 105 installation, removal and replacement in the fluid input bore 115, but, not enough friction to provide a locking taper between the surfaces 210, 300.

In some embodiments, to facilitate easy sleeve 105 installation, removal and replacement in the fluid input bore 115, the pump insertion side 205 of the sleeve 105 includes a tapered nose surface 260, the tapered nose surface forming an angle 330 of greater than 90 degrees relative to a long axis 251 of the sleeve 105. In some embodiments, to facilitate providing a liquid seal, the tapered outer surface 210 can include a first O-ring groove 262 sized to house a first O-ring 331 therein, the first O-ring groove 262 located between the tapered nose surface 260 and adjacent the tapered nose surface 260 (e.g., within 1 to 10 percent of the total length 252 of the sleeve, or, within 0.01 to 0.1 m of the nose surface 260 in some embodiments). As further discussed below, in some embodiments, a largest outer diameter 263 of the first O-ring groove, e.g., the largest outer diameter 263 of the groove sidewall 262*a*, can be smaller than a second inner diameter of the packing sleeve (e.g., second diameter 277).

In some embodiment, the first guiding outer surface 225 of the pilot and sealing segment 220 includes a second O-ring groove 265 sized to house a second O-ring 332 therein, and the second guiding outer surface 232 of the pilot and sealing segment 220 includes a third O-ring groove 268 sized to house a third O-ring 334 therein. In some embodiments, the second diameter 235 of the second guiding outer surface 232 is greater than or equal to an outer diameter of the second O-ring 332 when installed in the second O-ring groove 265

In some embodiment, the pilot and sealing segment 220 further includes a lubrication supply port 270 located in between the first and second guiding surfaces 225, 232. In some such embodiments, the pilot and sealing segment 220 further includes a relief surface 272 located in between the second O-ring groove 265 and the lubrication supply port 270, the relief surface defined by an outer diameter 274 that is greater (e.g., 1, 2, 3, 4, 5, 7, or 10% greater in various embodiments) than the first diameter 227 of the first guiding outer surface 225. The relief surface diameter 274 helps reduce the presence of metal burrs that can sometimes damage o-rings or seals in the sleeve.

In some embodiments, the packing sleeve 105 has an first inner diameter 275 sized to allowed a plunger 136 of the pump to reciprocate there-through and a second inner diameter 277 that is larger than the first inner diameter and sized for a packing stack 125 of the pump to be seated there-on.

In some such embodiments, to help hold the packing sleeve 105 in place in the input opening 115, the largest outer diameter 263 of the first O-ring groove 262 (e.g., groove sidewall 262*a*), can be smaller (e.g., 0.5, 1, 2, 3, 4 or 5 percent smaller in some embodiments) than the second inner diameter 277. In such embodiments, a discharge pressure acting on diameter 263 can apply a force to push the sleeve out, however, the discharge pressure acting on diameter 277 can apply another force to hold the sleeve in place. Because diameter 277 is greater than diameter 263, the net effect is that there is more force holding the sleeve in place than the force trying to push the sleeve out.

In some embodiments, the attachment segment 240 of the packing sleeve 105 further includes openings 280, each of the openings 280 sized to engage with a nut 140 connected to a packing screw 145, the packing screw including a rim 150 having holes 155 therein, the holes sized to fit a portion of a fastening tool 160 therein. The packing screw facilitates applying a final torque needed to retain the sleeve in the fluid input bore. In some such embodiments, e.g., the fastening tool is a metal bar (e.g., 0.25 to 1 m in length) to facilitate a single human user to rotate the packing screw by providing additional torque for rotationally transferring the sleeve into or out of the fluid input bore as further disclosed below.

Any embodiments of the sleeve can include a corrosion prevention coating 285 (e.g., a CrN coating, by physical vapor deposition method familiar to those skilled in the pertinent art) covering all or portion of the surface of the sleeve (e.g., any or all of surfaces 210, 225, 232 and 245). Because the disclosed sleeve do not use or require press fitting, there is a much lower risk of such a coating being scrapped off during installation removal or replacement of the sleeve.

Another embodiment of the disclosure is a method operating a pump for use in a hydraulic fracturing system.

With continuing references to FIGS. 1-5, FIGS. 6A and 6B present a flow diagram of a method 600 of operating a pump including installing (step 605), removing (step 660) and replacing (step 690) any embodiments of the packing sleeve 105 as disclosed herein.

Embodiments of the method (600) can include removing (step 650) the packing sleeve 105 from the pump, including: rotationally detaching (step 660) the threaded outer surface 245 of the attachment segment 240 of the packing sleeve 105 from the threaded inner attachment surface 320 of the fluid input bore 115 such that the packing sleeve is moved towards the opening 120; pulling (step 670) the packing sleeve further towards the opening such that first guiding outer surface 225 and a second guiding outer surface 232 of a pilot and sealing segment 220 of the packing sleeve 105 lose contact with the inner receiving surface 310 of the fluid input bore; and extracting (step 680) the pump insertion side 205 of the packing sleeve 105 out of the opening 120 of a fluid input bore 115 of the pump, including disengaging (step 682) the tapered outer surface 210 of the tapered segment 200 of the packing sleeve 105 with the flared inner surface 300 of the fluid input bore.

In some such embodiments, the rotational transferring (step 630) of the conical packing sleeve 205 into the opening 120 includes can further include attaching (step 632) a packing screw 145 to the pump removal side 242 of the packing sleeve including engaging a nut 140 of the packing screwing with an opening 280 in the attachment segment of the packing sleeve, fitting (step 634) a portion of a fastening tool 160 into holes 155 located in a rim 150 of packing screw and then actuating (step 636) the fastening tool to perform the rotational transferring (step 630).

Some such embodiments can further include inserting (step 640) a packing stack 125 into a pump removal side 242 of the packing sleeve such that the packing stack is seated on a second bore 282 of the packing sleeve, wherein the packing sleeve 105 has a first bore 284 with a first inner diameter 275 sized to allowed a plunger 136 of the pump to reciprocate there-through and the second bore 282 has a second inner diameter 277 that is larger than the first inner diameter 275.

Some embodiments of the method can include removing (step 650) the packing sleeve 105 from the pump, including: rotationally detaching (step 660) the threaded outer surface 245 of the attachment segment 240 of the packing sleeve 105 from the threaded inner attachment surface 320 of the fluid input bore 115 such that the packing sleeve is moved towards the opening 120; pulling (step 670) the packing sleeve further towards the opening such that first guiding outer surface 225 and a second guiding outer surface 232 of a pilot and sealing segment 220 of the packing sleeve 105 lose contact with the inner receiving surface 310 of the fluid input bore 115 and extracting (step 680) the pump insertion side 205 of the packing sleeve 105 out of the opening 120 of a fluid input bore 115 of the pump, including disengaging (step 682) the tapered outer surface 210 of the tapered segment 200 of the packing sleeve 105 with the flared inner surface 300 of the fluid input bore In some such embodiments, the rotationally detaching (step 660) can further include attaching (step 682) a packing screw 145 to the pump removal side 242 of the packing sleeve including engaging a nut 140 of the packing screwing with an opening 280 in the attachment segment of the packing sleeve, fitting (step 684) a portion of a fastening tool 160 into holes 155 located in a rim 150 of packing screw and then actuating (step 686) the fastening tool to perform the rotational detaching (step 660).

In some such embodiments, e.g., after the removing (step 650) of the packing sleeve 105 from the pump, replacing the packing sleeve (step 690) with a replacement packing sleeve including the installing (step 605) of the replacement packing sleeve 105 into the pump.

Disclosure Statements

Statement 1. A pump for use in a hydraulic fracturing system, the pump comprising a conical packing sleeve, including: a tapered segment adjacent a pump insertion side of the packing sleeve, the tapered segment including a tapered outer surface that is engageable with a flared inner surface in an opening of a fluid input bore of the pump; a pilot and sealing segment adjacent and contiguous with the tapered segment, the pilot and sealing segment including a first guiding outer surface defined by a first diameter that is greater than a largest diameter of the tapered segment, and a second guiding outer surface defined by a second diameter that is greater than the first diameter, the first and second guiding outer surfaces contactable with an inner receiving surface of the fluid input bore; and an attachment segment adjacent and contiguous with the pilot and sealing segment and adjacent a pump removal side of the packing sleeve, the attachment segment having a threaded outer surface that is attachable to a threaded inner attachment surface of the fluid input bore.

Statement 2. A length of the tapered outer surface, in a direction parallel to a long axis of the packing sleeve, extends from a first external o-ring groove located between the pump insertion side and the tapered segment to the pilot and sealing segment, has a value in a range from at least 30 to at most 60 percent of a total length of the conical packing sleeve along the long axis.

Statement 3. An outer angle of the tapered outer surface and an inner angle of the flared inner surface, relative to a long axis of the packing sleeve, are substantially equal to each other and both the outer angle and the inner angle are greater than, up to 1 degree, than a friction angle between the tapered outer surface and the flared inner surface, whereby the tapered outer surface and the flared inner surface are not locked together.

Statement 4. The outer angle of the tapered outer surface and an inner angle of the flared inner surface, relative to a long axis of the packing sleeve, are substantially equal to each other and both the outer angle and the inner angle are and the outer angle and the inner angle are from greater than 1 degree to 5 degrees greater than a friction angle between the tapered outer surface and the flared inner surface, whereby the tapered outer surface and the flared inner surface are not locked together.

Statement 5. An outer angle of the tapered outer surface and an inner angle of the flared inner surface, relative to a long axis of the packing sleeve, are substantially equal to each other and both the outer angle and the inner angle are less than a friction angle between the tapered outer surface and the flared inner surface to thereby lock the tapered outer surface and the flared inner surface together by a frictional force between the surfaces.

Statement 6. The outer angle and the inner angle are within 5 percent of the friction angle.

Statement 7. The pump insertion side includes a tapered nose surface, the tapered nose surface forming an angle of greater than 90 degrees relative to a long axis of the packing sleeve.

Statement 8. The tapered outer surface includes a first O-ring groove sized to house a first O-ring therein, the first O-ring groove adjacent the tapered nose surface.

Statement 9. The first guiding outer surface of the pilot and sealing segment includes a second O-ring groove sized to house a second O-ring therein, and the second guiding outer surface of the pilot and sealing segment includes a third O-ring groove sized to house a third O-ring therein.

Statement 10. The pilot and sealing segment further includes a lubrication supply port located in between the first and second guiding surfaces.

Statement 11. The pilot and sealing segment further includes a relief surface located in between the second O-ring groove and the lubrication supply port, the relief surface defined by a diameter that is greater than the first diameter of the first guiding outer surface.

Statement 12. The packing sleeve has a first inner diameter sized to allowed a plunger of the pump to reciprocate there-through and a second inner diameter that is larger than the first inner diameter and sized for a packing stack of the pump to be seated there-on.

Statement 13. The pump insertion side includes a first O-ring groove sized to house a first O-ring therein, the first O-ring groove located between the tapered nose surface and within the tapered outer surface, and, a largest outer diameter of the first O-ring groove is smaller than the second inner diameter.

Statement 14. The attachment segment of the packing sleeve further includes openings, each of the openings sized to engage with a nut connected to a packing screw, the packing screw including a rim having holes therein, the holes sized to fit a portion of a fastening tool therein.

Statement 15. A method of operating a pump for use in a hydraulic fracturing system, comprising: installing a conical packing sleeve into the pump, including: inserting a pump insertion side of the packing sleeve into an opening of a fluid input bore of the pump, including engaging a tapered outer surface of a tapered segment of the packing sleeve with a flared inner surface of the fluid input bore; pushing the packing sleeve further into the opening such that a first guiding outer surface and a second guiding outer surface of a pilot and sealing segment of the packing sleeve contact an inner receiving surface of the fluid input bore, wherein the first guiding outer surface has a first diameter that is greater than a largest diameter of the tapered segment and the second guiding outer surface has a second diameter that is greater than the first diameter; and rotationally transferring the conical packing sleeve further into the opening such that a threaded outer surface of an attachment segment of the packing sleeve attaches to a threaded inner attachment surface of the fluid input bore.

Statement 16. The rotational transferring of the conical packing sleeve into the opening includes further including attaching a packing screw to the pump removal side of the packing sleeve including engaging a nut of the packing screwing with an opening in the attachment segment of the packing sleeve, fitting a portion of a fastening tool into holes located in a rim of packing screw and then actuating the fastening tool to perform the rotational transferring.

Statement 17. Further including inserting a packing stack into a pump removal side of the packing sleeve such that the packing stack is seated on a second bore of the packing sleeve, wherein the packing sleeve has a first bore with a first inner diameter sized to allowed a plunger of the pump to reciprocate there-through and the second bore has a second inner diameter that is larger than the first inner diameter.

Statement 18. further including: removing the packing sleeve from the pump, including: rotationally detaching the threaded outer surface of the attachment segment of the packing sleeve from the threaded inner attachment surface of the fluid input bore such that the packing sleeve is moved towards the opening; pulling the packing sleeve further towards the opening such that first guiding outer surface and a second guiding outer surface of a pilot and sealing segment of the packing sleeve lose contact with the inner receiving surface of the fluid input bore; and extracting the pump insertion side of the packing sleeve out of the opening of a fluid input bore of the pump, including disengaging the tapered outer surface of the tapered segment of the packing sleeve with the flared inner surface of the fluid input bore.

Statement 19. The rotationally detaching further includes attaching a packing screw to the pump removal side of the packing sleeve including engaging a nut of the packing screwing with an opening in the attachment segment of the packing sleeve, fitting a portion of a fastening tool into holes located in a rim of packing screw and then actuating the fastening tool to perform the rotational detaching.

Statement 20. After the removing of the packing sleeve from the pump, replacing the packing sleeve with a replacement packing sleeve including the installing of the replacement packing sleeve into the pump.

Those skilled in the art to which this application relates will appreciate that other and further additions, deletions, substitutions and modifications may be made to the described embodiments.

What is claimed is:

1. A pump for use in a hydraulic fracturing system, the pump comprising:

a conical packing sleeve, including:

a tapered segment adjacent a pump insertion side of the packing sleeve, the tapered segment including a tapered outer surface that is engageable with a flared inner surface in an opening of a fluid input bore of the pump;

a pilot and sealing segment adjacent and contiguous with the tapered segment, the pilot and sealing segment including a first guiding outer surface defined by a first diameter that is greater than a largest diameter of the tapered segment, and a second guiding outer surface defined by a second diameter that is greater than the first diameter, the first and second guiding outer surfaces contactable with an inner receiving surface of the fluid input bore; and an attachment segment adjacent and contiguous with the pilot and sealing segment and adjacent a pump removal side of the packing sleeve, the attachment segment having a threaded outer surface that is attachable to a threaded inner attachment surface of the fluid input bore.

2. The pump of claim 1, wherein a length of the tapered outer surface, in a direction parallel to a long axis of the packing sleeve, extends from a first external o-ring groove located between the pump insertion side and the tapered segment to the pilot and sealing segment, has a value in a range from at least 30 to at most 60 percent of a total length of the conical packing sleeve along the long axis.

3. The pump of claim 1, wherein an outer angle of the tapered outer surface and an inner angle of the flared inner surface, relative to a long axis of the packing sleeve, are substantially equal to each other and both the outer angle and the inner angle are greater than, up to 1 degree, than a friction angle between the tapered outer surface and the flared inner surface, whereby the tapered outer surface and the flared inner surface are not locked together.

4. The pump of claim 3, wherein an outer angle of the tapered outer surface and an inner angle of the flared inner surface, relative to a long axis of the packing sleeve, are substantially equal to each other and both the outer angle and the inner angle are and the outer angle and the inner angle are from greater than 1 degree to 5 degrees greater than a friction angle between the tapered outer surface and the flared inner surface, whereby the tapered outer surface and the flared inner surface are not locked together.

5. The pump of claim 1, wherein an outer angle of the tapered outer surface and an inner angle of the flared inner surface, relative to a long axis of the packing sleeve, are substantially equal to each other and both the outer angle and the inner angle are less than a friction angle between the tapered outer surface and the flared inner surface to thereby lock the tapered outer surface and the flared inner surface together by a frictional force between the surfaces.

6. The pump of claim 5, wherein the outer angle and the inner angle are within 5 percent of the friction angle.

7. The pump of claim 1, wherein the pump insertion side includes a tapered nose surface, the tapered nose surface forming an angle of greater than 90 degrees relative to a long axis of the packing sleeve.

8. The pump of claim 1, wherein the tapered outer surface includes a first O-ring groove sized to house a first O-ring therein, the first O-ring groove adjacent the tapered nose surface.

9. The pump of claim 1, wherein the first guiding outer surface of the pilot and sealing segment includes a second O-ring groove sized to house a second O-ring therein, and the second guiding outer surface of the pilot and sealing segment includes a third O-ring groove sized to house a third O-ring therein.

10. The pump of claim 1, wherein the pilot and sealing segment further includes a lubrication supply port located in between the first and second guiding surfaces.

11. The pump of claim 10, wherein the pilot and sealing segment further includes a relief surface located in between the second O-ring groove and the lubrication supply port, the relief surface defined by a diameter that is greater than the first diameter of the first guiding outer surface.

12. The pump of claim 1, wherein the packing sleeve has a first inner diameter sized to allowed a plunger of the pump to reciprocate there-through and a second inner diameter that is larger than the first inner diameter and sized for a packing stack of the pump to be seated there-on.

13. The pump of claim 12, wherein the pump insertion side includes a first O-ring groove sized to house a first O-ring therein, the first O-ring groove located between the tapered nose surface and within the tapered outer surface, and, a largest outer diameter of the first O-ring groove is smaller than the second inner diameter.

14. The pump of claim 1, wherein the attachment segment of the packing sleeve further includes openings, each of the openings sized to engage with a nut connected to a packing screw, the packing screw including a rim having holes therein, the holes sized to fit a portion of a fastening tool therein.

15. A method of operating a pump for use in a hydraulic fracturing system, comprising:

installing a conical packing sleeve into the pump, including:

inserting a pump insertion side of the packing sleeve into an opening of a fluid input bore of the pump, including engaging a tapered outer surface of a tapered segment of the packing sleeve with a flared inner surface of the fluid input bore;

pushing the packing sleeve further into the opening such that a first guiding outer surface and a second guiding outer surface of a pilot and sealing segment of the packing sleeve contact an inner receiving surface of the fluid input bore, wherein the first guiding outer surface has a first diameter that is greater than a largest diameter of the tapered segment and the second guiding outer surface has a second diameter that is greater than the first diameter; and rotationally transferring the conical packing sleeve further into the opening such that a threaded outer surface of an attachment segment of the packing sleeve attaches to a threaded inner attachment surface of the fluid input bore.

16. The method of claim 15, wherein the rotational transferring of the conical packing sleeve into the opening includes further including attaching a packing screw to the pump removal side of the packing sleeve including engaging a nut of the packing screwing with an opening in the attachment segment of the packing sleeve, fitting a portion of a fastening tool into holes located in a rim of packing screw and then actuating the fastening tool to perform the rotational transferring.

17. The method of claim 15, further including inserting a packing stack into a pump removal side of the packing sleeve such that the packing stack is seated on a second bore of the packing sleeve, wherein the packing sleeve has a first bore with a first inner diameter sized to allowed a plunger of the pump to reciprocate there-through and the second bore has a second inner diameter that is larger than the first inner diameter.

18. The method of claim 15, further including:

removing the packing sleeve from the pump, including:

rotationally detaching the threaded outer surface of the attachment segment of the packing sleeve from the threaded inner attachment surface of the fluid input bore such that the packing sleeve is moved towards the opening;

pulling the packing sleeve further towards the opening such that first guiding outer surface and a second guiding outer surface of a pilot and sealing segment of the packing sleeve lose contact with the inner receiving surface of the fluid input bore; and extracting the pump insertion side of the packing sleeve out of the opening of a fluid input bore of the pump, including disengaging the tapered outer surface of the tapered segment of the packing sleeve with the flared inner surface of the fluid input bore.

19. The method of claim 18, wherein the rotationally detaching further includes attaching a packing screw to the pump removal side of the packing sleeve including engaging a nut of the packing screwing with an opening in the attachment segment of the packing sleeve, fitting a portion of a fastening tool into holes located in a rim of packing screw and then actuating the fastening tool to perform the rotational detaching.

20. The method of claim 18, wherein after the removing of the packing sleeve from the pump, replacing the packing sleeve with a replacement packing sleeve including the installing of the replacement packing sleeve into the pump.

* * * * *